United States Patent [19]

Dahlquist

[11] Patent Number: 4,645,438

[45] Date of Patent: Feb. 24, 1987

[54] GEROTOR MOTOR AND IMPROVED LUBRICATION FLOW CIRCUIT THEREFOR

[75] Inventor: Rohland A. Dahlquist, St. Louis Park, Minn.

[73] Assignee: Eaton Corporation, Cleveland, Ohio

[21] Appl. No.: 795,590

[22] Filed: Nov. 6, 1985

[51] Int. Cl.[4] ..... F01C 1/10; F01C 21/04; F03C 2/08

[52] U.S. Cl. ..... 418/61 B; 418/102

[58] Field of Search ..... 418/61 B, 102; 184/6.16, 31

[56] References Cited

U.S. PATENT DOCUMENTS

| | | | |
|---|---|---|---|
| 3,862,814 | 1/1975 | Swedberg | 418/102 |
| 3,895,689 | 7/1975 | Swearingen | 184/6.16 |
| 4,035,113 | 7/1977 | McDermott | 418/102 |
| 4,171,938 | 10/1979 | Pahl | 418/102 |
| 4,343,601 | 8/1982 | Thorson | 418/61 B |
| 4,533,302 | 8/1985 | Begley | 418/102 |

FOREIGN PATENT DOCUMENTS

| | | | |
|---|---|---|---|
| 60335 | 7/1913 | Austria | 184/6.16 |
| 154840 | 4/1982 | German Democratic Rep. | 418/102 |

*Primary Examiner*—John J. Vrablik

*Attorney, Agent, or Firm*—D. A. Rowe; L. J. Kasper

[57] ABSTRACT

A rotary fluid pressure device (11) is disclosed of the type having a fluid displacement means (17), an inlet port (57), an outlet port (61) and a valve means (55) which cooperates with a housing (21;101;201) to define a main flow path communicating from the inlet to the volume chambers of the mechanism (17) and then to the outlet. The device includes an arrangement such as an orifice (89) or shuttle valve (111) having its inlet in communication with the main flow path downstream of the contracting volume chambers (29). The motor includes a lubricant flow path (81,83; 107,109; 207) which provides lubricant to the bearings and shaft splines. The orifice (89) or shuttle valve (111) provides a generally constant flow of lubricant despite variations in the motor load or motor speed.

9 Claims, 3 Drawing Figures

GEROTOR MOTOR AND IMPROVED LUBRICATION FLOW CIRCUIT THEREFOR

BACKGROUND OF THE DISCLOSURE

The present invention relates to rotary fluid pressure devices such as low-speed, high-torque gerotor motors, and more particularly, to an improved lubrication flow circuit therefor.

A typical motor of the type to which the present invention relates includes a housing defining inlet and outlet ports and some type of fluid energy-translating displacement mechanism, such as a gerotor gear set. The typical motor further includes valve means to provide fluid communication between the ports and the volume chambers of the displacement mechanism. The invention is especially advantageous when used in a device wherein the displacement mechanism is a gerotor gear set including an orbiting and rotating gerotor star, and will be described in connection therewith.

In gerotor motors, an externally-splined main drive shaft (dogbone) is typically used to transmit torque from the orbiting and rotating gerotor star to the rotating output shaft. In order for the motor to have adequate operating life, it is important that these torque-transmitting spline connections be lubricated by a flow of lubricating fluid. It is also important that certain other elements of the motor be lubricated, such as any bearings which may be used to rotatably support the output shaft relative to the motor housing.

In many gerotor motors of the type described above, there is no actual lubrication flow path, but instead, merely a stagnant region of fluid (e.g., surrounding the spline connections) in parallel with the main system flow path. Such an arrangement does not necessarily result in heat and contamination particles being transferred from the splines and out of the motor as is most desirable.

In certain other prior art motors of the type described above, it has been known to provide a controlled amount of lubrication flow, in parallel with the main system flow path, by means of one or more metering notches defined by the rotary valve member, or by means of an extra amount of side clearance between the gerotor star and the adjacent housing surface. See for example, U.S. Pat. Nos. 3,572,983 and 3,862,814, both assigned to the assignee of the present invention. The resulting lubricant flow is "forward", i.e., toward the output shaft end of the motor, through the dogbone spline connections, and then through the bearings, and eventually to the outlet port.

In a recent improvement of the above-described lubrication arrangement, lubricant recesses have been provided in the end surface of the housing adjacent the internal teeth of a roller gerotor. These lubricant recesses cooperate with the clearance spaces at the ends of the gerotor rollers to generate a flow of lubricant which is then communicated to the lubrication flow path through the splines and bearings. See U.S. Pat. No. 4,533,302, also assigned to the assignee of the present invention.

Although the methods for providing lubricant flow described in the preceding two paragraphs have been in widespread commercial use and have been generally satisfactory, both methods have the disadvantage that the volume of lubricant flow is generally proportional to the load imposed on the motor, as represented by the pressure differential across the gerotor, or between the inlet and outlet ports. When a low-speed, high-torque gerotor motor is being operated at a pressure differential of 2,000 or 3,000 psi, and an output speed in the range of about 50 to 300 rpm, there typically is sufficient lubricant flow generated. However, during times when the motor is being operated at relatively high speed (e.g., 500 rpm), and at relatively low load (e.g., a pressure differential of about 500 psi), substantially less lubricant flow is generated. Unfortunately, it is during periods of such relative high speed, low load operation that greater lubricant flow is required because of the greater amount of rubbing action and stress on elements such as the splines, resulting in greater heat generation and an increase in contamination particles.

SUMMARY OF THE INVENTION

Accordingly, it is an object of the present invention to provide a rotary fluid pressure device having an improved lubrication flow circuit, and especially, having a lubrication flow circuit in which the volume of lubrication flow is largely independent of the speed at which the motor is operating, and of the pressure differential across the motor.

It is a more specific object of the present invention to provide such an improved lubrication flow circuit in which the volume of lubricant flow is relatively constant, regardless of variations in motor speed and pressure differential.

It is a further object of the present invention to provide an improved lubrication flow circuit which does not adversely affect the volumetric efficiency of the motor.

The above and other objects of the present invention are accomplished by the provision of a rotary fluid pressure device of the type including housing means defining a fluid inlet and a fluid outlet. A fluid energy-translating displacement means is associated with the housing and includes at least one member having rotational movement relative to the housing to define expanding and contracting fluid volume chambers. A valve means cooperates with the housing means to define a main fluid flow path providing fluid communication between the fluid inlet and the expanding fluid volume chambers and between the contracting fluid volume chambers and the fluid outlet. An input-output shaft means is supported for rotation relative to the housing and included is a means for transmitting torque from the member of the displacement means having rotational movement to the input-output shaft means. The motor includes means defining a lubrication flow path which includes the torque-transmitting means.

The improved device is characterized by: (a) means providing restricted fluid flow and having an inlet in fluid communication with the main fluid flow path downstream of the contracting fluid volume chambers, and an outlet in fluid communication with the lubrication flow path; (b) the restricted flow means being operable to communicate a generally constant fluid flow from its inlet to its outlet, despite variations in the pressure differential across the main fluid flow path and variations in the rate of flow through the main fluid flow path.

DESCRIPTION OF THE PREFERRED EMBODIMENTS

Figure 1:
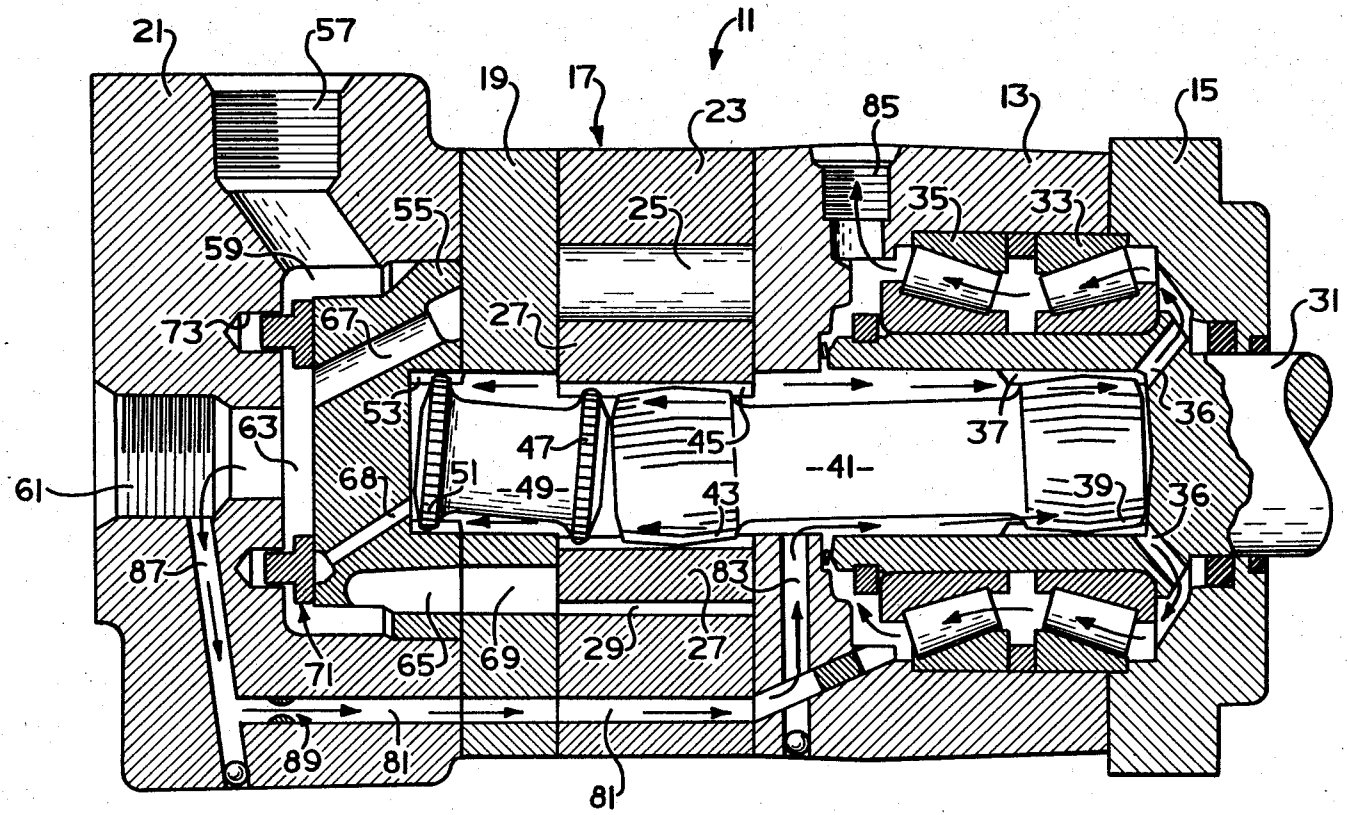
FIG. 1 is an axial cross-section of a low-speed, high-torque gerotor motor utilizing the improved lubrication flow circuit of the present invention.

Referring now to the drawings, which are not intended to limit the invention, FIG. 1 illustrates a low-speed, high-torque gerotor motor of the type to which the present invention may be applied, and which is illustrated and described in greater detail in U.S. Pat. Nos. 3,572,983 and 4,343,600, both of which are assigned to the assignee of the present invention and are incorporated herein by reference.

The hydraulic motor shown in FIG. 1 comprises a plurality of sections secured together, such as by a plurality of bolts (not shown). The motor, generally designated 11, includes a shaft support casing 13, a front cover 15, a gerotor displacement mechanism 17, a port plate 19, and a valve housing portion 21.

The gerotor displacement mechanism 17 is well known in the art, is shown and described in greater detail in the incorporated patents, and will be described only briefly herein. More specifically, the displacement mechanism 17 is a roller gerotor comprising an internally-toothed ring 23 defining a plurality of generally semi-cylindrical pockets or openings, with a cylindrical roller member 25 disposed in each of the openings. Eccentrically disposed within the ring 23 is an externally-toothed star 27, typically having one less external tooth than the number of cylindrical rollers 25, thus permitting the star 27 to orbit and rotate relative to the ring 23. The relative oribital and rotational movement between the ring 23 and star 27 defines a plurality of expanding and contracting volume chambers 29.

Referring still to FIG. 1, the motor includes an output shaft 31 positioned within the shaft support casing 13 and rotatably supported therein by suitable bearing sets 33 and 35. The shaft 31 defines a pair of angled fluid passages 36 which will be referenced subsequently in connection with the lubrication flow circuit of the invention. The shaft 31 includes a set of internal, straight splines 37, and in engagement therewith is a set of external, crowned splines 39 formed on one end of a main drive shaft 41. Disposed at the opposite end of the main drive shaft 41 is another set of external, crowned splines 43, in engagement with a set of internal, straight splines 45, formed on the inside diameter of the star 27. Therefore, in the subject embodiment, because the ring 23 includes seven internal teeth 25, and the star 27 includes six external teeth, six orbits of the star 27 result in one complete rotation thereof, and one complete rotation of the main drive shaft 41 and the output shaft 31.

Also in engagement with the internal splines 45 is a set of external splines 47 formed about one end of a valve drive shaft 49 which has, at its opposite end, another set of external splines 51 in engagement with a set of internal splines 53 formed about the inner periphery of a valve member 55. The valve member 55 is rotatably disposed within the valve housing 21. The valve drive shaft 49 is splined to both the star 27 and the valve member 55 in order to maintain proper valve timing therebetween, as is generally well known in the art.

The valve housing 21 includes a fluid port 57 in communication with an annular chamber 59 which surrounds the valve member 55. The valve housing 21 also includes an outlet port 61 which is in fluid communication with a chamber 63 disposed between the valve housing 21 and valve member 55. The valve member 55 defines a plurality of alternating valve pssages 65 and 67, the passages 65 being in continuous fluid communication with the annular chamber 59, and the passage 67 being in continuous fluid communication with the chamber 63. In the subject embodiment, there are six of the passages 65, and six of the passages 67, corresponding to the six external teeth of the star 27. The valve member 55 also defines an angled drain passage 68 which will be discussed further subsequently. The port plate 19 defines a plurality of fluid passages 69 (only one of which is shown in FIG. 1), each of which is disposed to be in continuous fluid communication with the adjacent volume chamber 29.

As is well known to those skilled in the art, it is necessary to maintain the valve member 55 in sealing engagement with the adjacent surface of the port plate 19, to prevent cross port leakage between the fluid chambers 59 and 63. To effect such sealing, a valve seating mechanism 71 is included, seated within an annular groove 73 defined by the valve housing 21. The valve seating mechanism 71 is well known in the art (see previously cited U.S. Pat. No. 3,572,983) and will not be described in detail herein.

The general operation of the low-speed, high-torque gerotor motor shown in FIG. 1 is well known to those skilled in the art and is described in detail in the above-incorporated patents. For purposes of this description, it is sufficient to note that, for example, high-pressure fluid may be communicated to the inlet port 57 and from there will flow through the chamber 59, the valve passages 65, the fluid passages 69, and enter the expanding volume chambers 29, causing the rotor 27 to orbit and rotate. This movement of the rotor 27 will be transmitted by means of the main drive shaft 41 to the output shaft 31, causing rotation thereof. As the rotor 27 orbits and rotates, low-pressure fluid is exhausted from the contracting volume chambers 29 and is communicated through the respective fluid passages 69 and valve passages 67 to the fluid chamber 63, and then out to the fluid port 61. As will be understood by those skilled in the art, the path described above by which fluid flows from the inlet port 57 to the outlet port 61 is considered the "main fluid flow path" of the motor. The pressure drop from the port 57 to the port 61 is representative of the load on the motor, and the rate of fluid flow through the above-described path is representative of the output speed of the motor, i.e., the speed of rotation of the output shaft 31.

FIG. 1 Embodiment

Referring still to FIG. 1, it may be seen that the gerotor ring 23, the port plate 19, and the valve housing 21 cooperate to define a lubricant passage 81. The shaft support casing 13 defines a lubricant passage 83 which is directed radially inwardly toward the drive shaft 41. The casing 13 further defines a case drain outlet 85 which is in open fluid communication with the region between the output shaft 31 and the casing 13 in which the bearing sets 33 and 35 are disposed.

The valve housing 21 defines a fluid passage 87 which communicates between the outlet port 61 and the lubricant passage 81, this arrangement being shown only schematically in FIG. 1. Disposed within the lubricant passage 81 is a fluid restriction orifice 89, the function of which is to provide a generally constant rate of fluid flow from the outlet port 16 through the lubricant passage 81. It should be understood by those skilled in the art that the location of the orifice 89 in the passage 81 is not critical, and the orifice 89 could just as easily be located in the fluid passage 87. Those skilled in the art will also understand that, in order to accomplish the purposes of the present invention, it is necessary that there be a flow restriction in the fluid conduit connecting the outlet port 61 to the reservoir (not shown in the drawings). With the downstream restriction being properly chosen, there will be a back pressure present in the outlet port 61. This back pressure will be known and relatively constant and therefore, because the orifice 89 is fixed, the flow through the orifice 89 into the passage 81 will be generally constant.

In accordance with this invention, the lubricant passage 81, downstream of the orifice 89, may be considered the beginning of the lubrication flow path. The generally constant flow through the orifice 89 flows through the passage 81 and enters the passage 83, which opens into the central case drain region of the motor, i.e., the region surrounding the main drive shaft 41. As the lubrication fluid enters the case drain region, a portion flows to the left in FIG. 1 through the rearward spline connection (splines 43 and 45), then flows into the spline connections of the valve drive shaft 49 than flows through the drain passage 68, and then toward whichever port is the outlet port. At the same time, the remainder of the lubrication fluid flows to the right in FIG. 1 through the forward spline connection (splines 37 and 39), then flows through the angled passages 36. The fluid which flows through the passages 36 then flows through the bearing set 33, then through the bearing set 35 and then out through the case drain outlet 85.

Accordingly, the present invention provides an improved lubrication flow circuit which provides a generally constant flow of lubricant, despite variations in the pressure differential across the main fluid flow path and despite variations in the rate of flow through the main fluid flow path. In the embodiment of FIG. 1, the lubricant flows first through the forward spline connection, which typically is the most critical area of the motor in terms of lubrication needs, then the lubricant flows through the bearings. It is an important aspect of the present invention that fluid entering the motor flows through the main flow path first, flowing through the valve and the gerotor volume chambers to perform the useful work required of the motor, and only after the work has been performed is the fluid used for lubrication. Therefore, contamination particles and heat transferred to the fluid as the fluid flows through the forward spline connections and through the bearings is immediately removed from the motor through the case drain outlet 85.

It will be understood by those skilled in the art the the arrangement illustrated in FIG. 1 should be used only when it is known that the motor 11 will be operated in only one direction, such that the port 57 is always the high-pressure inlet port, and the port 61 is always the low-pressure outlet port. If the port connections were reversed, to reverse direction of rotation of the output shaft 31, there would be high pressure in the passage 87 as well as in the passages 81 and 83, which would subject various parts such as seals to high pressure, and would also result in high-pressure fluid being communicated to the case drain outlet 85 without doing any useful work.

FIG. 2 Embodiment

Figure 2:
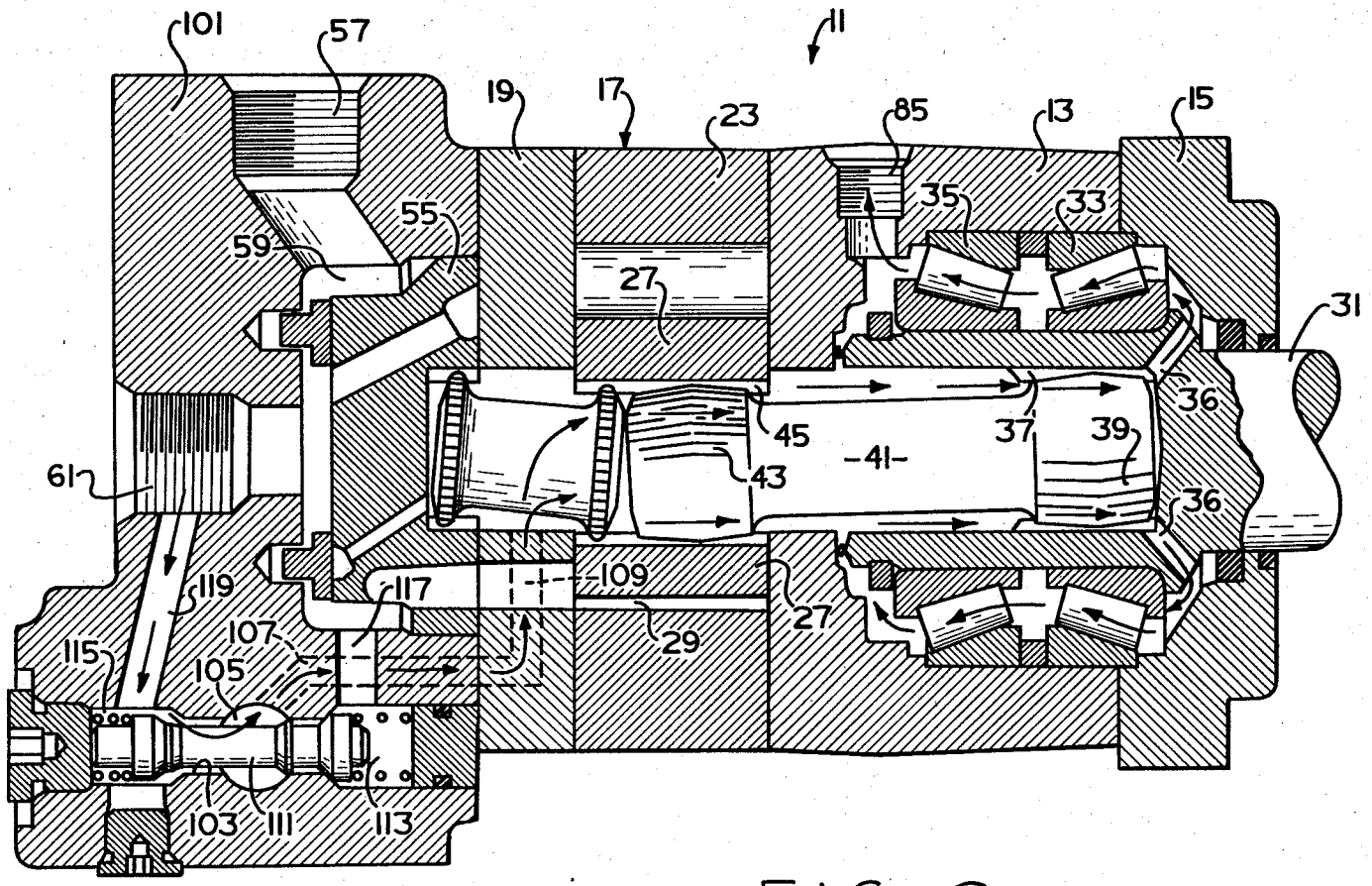
FIG. 2 is a view similar to FIG. 1 illustrating an alternative embodiment of the present invention.

Referring now to FIG. 2, there is illustrated an alternative embodiment of the present invention in which like elements bear like numerals, and new or substantially modified elements bear numerals in excess of 100. One primary difference between the embodiments of FIGS. 1 and 2 is that the FIG. 2 embodiment permits bi-directional motor operation, i.e., if the port 57 is connected to high pressure, the shaft 31 will rotate in one direction, whereas if the port 61 is connected to high pressure, the shaft 31 will rotate in the opposite direction.

In the embodiment of FIG. 2, there is a somewhat modified valve housing portion 101 which defines a stepped, axially-oriented bore 103. In communication with the axial bore 103 is a transverse bore 105 which, in turn, communicates with an axial lubricant passage 107 and a radial lubricant passage 109, the passages 107 and 109 being shown only schematically in FIG. 2.

Disposed within the axial bore 103 is a shuttle valve 111 which defines, at its opposite ends, a pair of pressure chambers 113 and 115.

In the embodiment of FIG. 2, the annular chamber 59 surrounding the valve member 55 is in fluid communication with the pressure chamber 113 by means of a passage 117, while the port 61 is in communication with the pressure chamber 115 by means of a passage 119.

In describing the operation of the FIG. 2 embodiment, it will be assumed that the port 57 is connected to high pressure, while the port 61 is the outlet port. As a result, high pressure in port 57 and chamber 59 is communicated through passage 117 to the chamber 113, thus biasing the shuttle valve 111 to the position shown in FIG. 2. At the same time, low-pressure fluid is communicated from the outlet port 61 through the passage 119, then past the shuttle valve 111 into the transverse bore 105. With the shuttle valve 111 biased to the position shown in FIG. 2, there is effectively a fixed orifice or fixed flow area established from the passage 119 to the bore 105, such that the rate of flow past the shuttle valve 111 will be generally constant despite variations in the pressure differential across the main fluid flow path, or the rate of flow therethrough.

The flow of lubricant fluid is communicated from the bore 105 to the lubricant passages 107 and 109, such that the lubricant flows into the central case drain region (see arrows), with the majority of the lubricant flowing through the rearward splined connection (splines 43 and 45), then through the forward splined connection (splines 37 and 39). From the forward splined connection, the lubricant flows through the passages 36, then through the bearing sets 33 and 35 and out the case drain outlet as was described in connection with the embodiment of FIG. 1. One advantage which should be noted in connection with the FIG. 2 embodiment is that substantially the entire lubricant flow passes through both the rearward and forward splined connections in series, rather than flowing through the two splined connections in parallel as in FIG. 1. Also, as was noted previously, the embodiment of FIG. 2 permits bi-directional motor operation, in which case the shuttle valve 111 moves to the right in FIG. 2 and low-pressure fluid is communicated from the chamber 59 through the passage 117 to the bore 105, but the remainder of the lubricant flow path is the same as previously described.

FIG. 3 Embodiment

Figure 3:
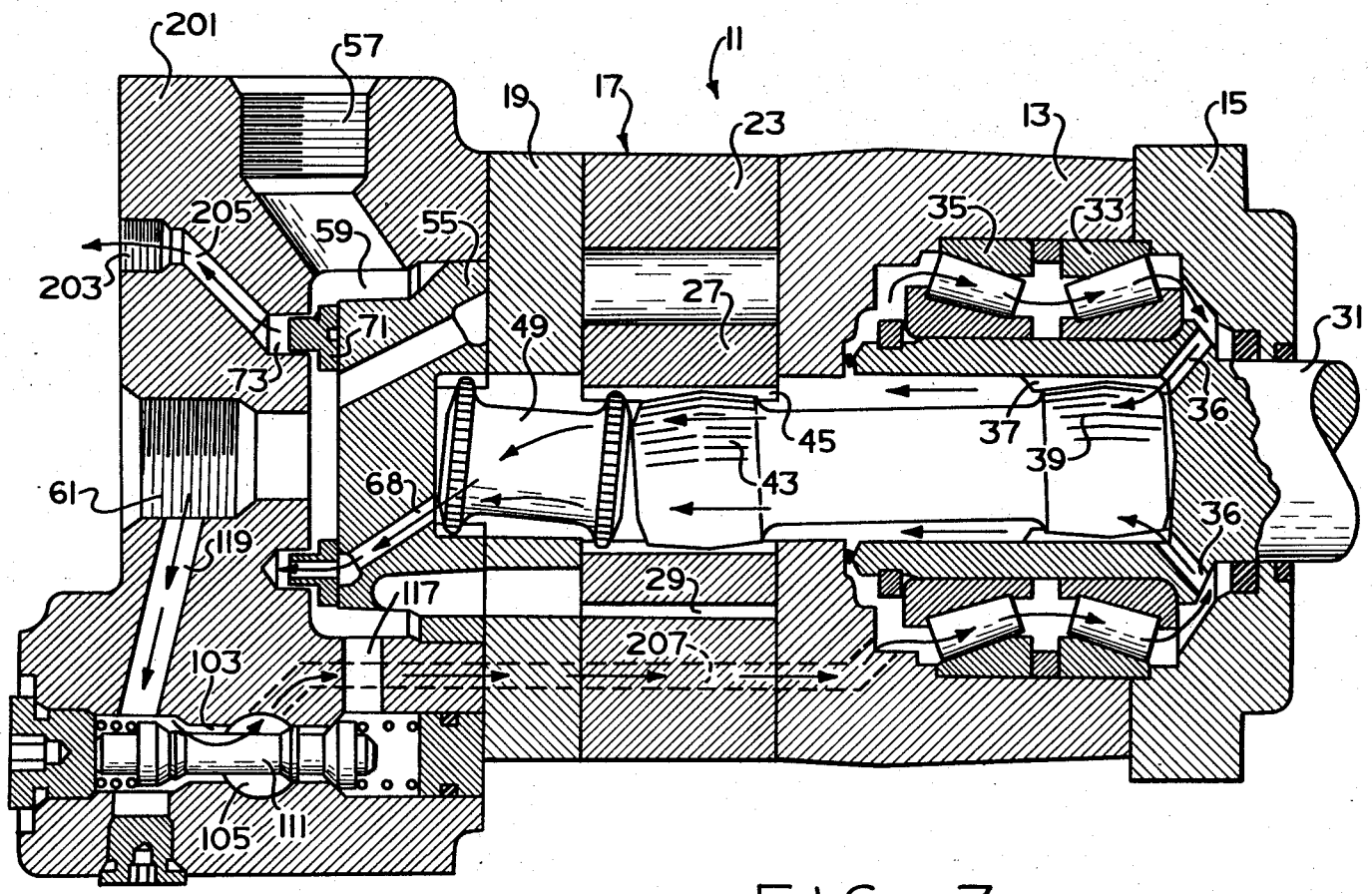
FIG. 3 is a view similar to FIGS. 1 and 2, illustrating a second alternative embodiment of the present invention.

Referring now to FIG. 3, there is illustrated yet another alternative embodiment of the present invention in which elements which are the same or substantially the same as in the embodiments of FIGS. 1 and 2 bear the same numerals, and new elements bear reference numerals in excess of 200. In the embodiment of FIG. 3, there is a valve housing 201 which may be the same as the valve housing 101 in the FIG. 2 embodiment, but includes, in addition, a case drain outlet 203 which communicates with the annular groove 73 by means of a drain passage 205.

In communication with the transverse bore 105 is an axial lubrication passage 207 which is defined by the valve housing 201, the port plate 19, the gerotor ring 23, and the shaft support casing 13. At its forward end (right end in FIG. 3) the lubrication passage 207 communicates with the chamber in which the bearing sets 33 and 35 are disposed.

For purpose of describing the operation of the FIG. 3 embodiment, it will again be assumed that the port 57 is connected to the source of high-pressure fluid. Therefore, low-pressure fluid will be communicated from the outlet port 61 through the passage 119, then past the shuttle valve 111 into the bore 105 in the same manner as described in connection with FIG. 2.

Lubricant fluid flowing out of the bore 105 enters the lubrication passage 207 and flows forward, through the rear bearing set 35, then through the forward bearing set 33 and into the angled passages 36. The lubricant then flows rearward through the forward splined connection (splines 37 and 39) and then through the rearward splined connection (splines 43 and 45), then through the splines of the valve drive shaft 49. Finally, the lubricant flows through the drain passage 68 and into the annular groove 73 by means of one or more axial passages defined by the valve seating mechanism 71. The lubricant then flows through the drain passage 205 and out the case drain outlet 203.

It will be understood by those skilled in the art that the three embodiments of the invention include features which could be combined differently than illustrated herein. For example, the orifice 89 of the FIG. 1 embodiment could be used to provide lubricant to the lubrication passage 207 of the FIG. 3 embodiment, etc. It is believed that upon a reading and understanding of the foregoing specification, various other alterations and modifications will become apparent to those skilled in the art. It is intended that the present invention includes all such alterations and modifications insofar as they come within the scope of the appended claims.

I claim:

1. A rotary fluid pressure device of the type including housing means defining fluid inlet means and fluid outlet means; fluid energy-translating displacement means associated with said housing means and including at least one member having rotational movement relative to said housing means to define expanding and contracting fluid volume chambers during said rotational movement; valve means cooperating with said housing means to define a main fluid flow path providing fluid communication between said fluid inlet means and said expanding fluid volume chambers and between said contracting fluid volume chambers and said fluid outlet means; input-output shaft means supported for rotation relative to said housing means; means for transmitting torque from said member of said displacement means having rotational movement to said input-output shaft means; and means defining a lubrication flow path including said torque-transmitting means, characterized by:

(a) means providing restricted fluid flow and having an inlet in fluid communication with said main fluid flow path downstream and said contracting fluid volume chambers, at a location disposed between said valve means and said fluid outlet means and an outlet in fluid communication with said lubrication flow path;

(b) said restricted flow means being operable to communicate a generally constant fluid flow from its inlet to its outlet, despite variations in the pressure differential across said main fluid flow path and the rate of flow through said main fluid flow path.

2. A rotary fluid pressure device as claimed in claim 1 characterized by said torque-transmitting means comprising a main drive shaft cooperating with said input-output shaft means to define a forward torque-transmitting connnection means.

3. A rotary fluid pressure device as claimed in claim 2 characterized by said main drive shaft cooperating with said member of said displacement means having rotational movement to define a rearward torque-transmitting connection means, said lubrication flow path including, in any order, said forward and rearward torque-transmitting connection means.

4. A rotary fluid pressure device as claimed in claim 3 characterized by bearing means disposed radially between said input-output shaft means and said housing means to support said shaft means for rotation relative to said housing means.

5. A rotary fluid pressure device as claimed in claim 4 characterized by said lubrication flow path including, in the order indicated:

(i) flow through said forward torque-transmitting connection means; and (ii) flow through said bearing means.

6. A rotary fluid pressure device as claimed in claim 4 characterized by said lubrication flow path including, in the order indicated:

(i) flow through said rearward torque-transmitting connection means;

(ii) flow through said forward torque-transmitting connection means; and (iii) flow through said bearing means.

7. A rotary fluid pressure device as claimed in claim 4 characterized by said lubrication flow path including, in the order indicated:

(i) flow through said bearing means;

(ii) flow through said forward torque-transmitting connection means; and (iii) flow through said rearward torque-transmitting connection means.

8. A rotary fluid pressure device as claimed in claim 1 characterized by said means providing restricted fluid flow comprising a valve means.

9. A rotary fluid pressure device as claimed in claim 8 characterized by said valve means comprising a shuttle valve having an inlet end in fluid communication with said main fluid flow path downstream of said contracting fluid volume chambers, an opposite end in fluid communication with said main fluid flow path upstream of said contracting fluid volume chambers, and an outlet in fluid communication with said lubrication flow path.

* * * * *